United States Patent [19]

Perrott

[11] 4,296,901

[45] Oct. 27, 1981

[54] TRANSPORTATION SYSTEMS

[76] Inventor: Francis C. Perrott, The Manor House, South Cerney, Cirencester, Gloucestershire, England

[21] Appl. No.: 109,182

[22] Filed: Jan. 2, 1980

[30] Foreign Application Priority Data

Jan. 2, 1979 [GB] United Kingdom ..... 00046/79
Apr. 27, 1979 [GB] United Kingdom ..... 14658/79
Sep. 29, 1979 [GB] United Kingdom ..... 33865/79

[51] Int. Cl.[3] ..... B61L 3/00

[52] U.S. Cl. ..... 246/167 R; 246/182 R; 246/187 B; 246/187 C; 104/299; 104/300

[58] Field of Search ..... 246/63 R, 187 B, 187 C, 246/182 B, 167 R, 2.5, 5; 104/299, 300, 301, 295, 298

[56] References Cited

U.S. PATENT DOCUMENTS 3,587,470 3/1968 Wilson ..... 104/300 X
3,661,093 5/1972 Searle ..... 246/63 R X
3,687,082 8/1972 Burke, Jr. ..... 104/300 X
3,788,234 1/1974 Jeffries ..... 104/299 X
3,964,702 6/1976 Lardennois et al. ..... 246/167 R X
3,991,958 11/1976 Sibley et al. ..... 246/63 R X

*Primary Examiner*—J. D. Miller
*Assistant Examiner*—Reinhard J. Eisenzopf
*Attorney, Agent, or Firm*—Young & Thompson

[57] ABSTRACT

A transportation system comprising a plurality of driven vehicles movable along a track and controlled by the provision of deterministic cells, defined by track-to-vehicle speed and/or position command signals, which move along the track, each vehicle being confined within the limits of a cell but being capable of autonomous movement relative thereto to permit the formation of a contact train with other vehicles within the cell. A control is provided to close-up vehicles within a cell, and there may also be provided on board each vehicle three coordinated closed-loop subsystems, governing respectively the vehicle speed, position and closing speed relative to an adjacent vehicle.

12 Claims, 19 Drawing Figures

TRANSPORTATION SYSTEMS

BACKGROUND OF THE INVENTION

This invention relates to transportation systems in which driven vehicles are movable along a track, and particularly, but not exclusively, to such systems employing electrically driven fully automatic vehicles. It has for its objects to reduce the cost and visual intrusion of the track, and to increase reliability as well as providing such other improvements as will be hereinafter mentioned.

Track costs may be reduced by reducing vehicle size and weight. In a transportation system according to the invention, vehicle size and weight may be reduced by means whereby trains of smaller individual vehicles are enabled, collectively, to carry as many passagers per unit time as the shorter trains of individually larger vehicles which have generally been employed hitherto. Track visual intrusion may consequently be reduced by the smaller track size permitted by reduced vehicle size. Reliability may be increased by the provision on each vehicle of an on-board diagnostic computer, whereby the cause of any incipient breakdown may be established and, provided it is safe to do so, the vehicle concerned may complete its journey before being withdrawn from service.

SUMMARY OF THE INVENTION

According to the invention there is provided a transportation system comprising a plurality of driven vehicles movable along a track, and means providing a plurality of deterministic cells (as hereinafter defined) movable along the track such that vehicles within each cell are confined within the limits of that cell, but are capable of autonomous movement relative thereto to permit the formation of a contact train within the cell.

By a "cell" is meant a length of track the boundaries at which, at any instant, are determined by the characteristics of command signals conveyed to vehicles occupying that length of track. Such a cell may thus be moved along the track, continuously or in finite steps, by sequential variation in said command signals along the track. A deterministic cell is a cell the size and position of which, at any given time, are predetermined.

Cell length may be pre-set to meet maximum train length requirements. The contact trains may comprise either coupled vehicles, vehicles in end-to-end contact but uncoupled, or separated vehicles provided with on-board separation control acting by a transmission between adjacent vehicles directly. Means may be provided automatically to adjust contact train length to meet traffic requirements at any time, including zero vehicles when no vehicles are required. Each individual vehicle may be controlled by an on-board computer. This may control its longitudinal position within the cell, and/or its routing at junctions and/or diagnose defects and, optionally, take remedial action.

Each cell may be controlled by a stationary control unit or computer. This may control the movement of the cell around the track and/or a series of vehicle commands relating to nominal position, speed, and/or other operational parameters of the vehicles within the cell. One such control unit may control the whole track system, or a portion thereof.

The stationary control unit may govern the longitudinal separation of the cells, ensuring that such separation is adequate at all times. It may also co-ordinate the movements of cells whereby it is ensured that they safely and consecutively pass convergent junctions. It may also govern the lengths of cells leaving stations, whereby stochastic or random short term requirements are spread over and met by consecutive cells so that the overloading of any portion of the track is avoided. An advantage of deterministic cells is that they automatically limit entries in this way, while ensuring opportunities for additional vehicles to join them further on, and while always making available the optimum safe track utilisation for merging.

Each cell may comprise a vehicle speed command, which is the same for all vehicles within the cell, and the same as the speed of the cell itself. There may be provided, at the trailing end of each cell, a vehicle speed command greater than the speed command within the cell, and, at the leading end of the cell, a vehicle speed command less than the speed command within the cell.

Where the track includes one or more divergent junctions, each cell may be duplicated on each of the two lengths of track diverging from each said junction, said vehicles being provided with automatic on-board means whereby consecutive vehicles in said cell may route themselves to one or other of said diverging lengths of track. The duplicated cells may subsequently be shortened to conform to the maximum number of vehicles to be contained therein.

Where the track includes one or more convergent junctions, there may be provided control means to cause cells to pass each convergent junction consecutively, in associated pairs, one from each of the two lengths of track converging towards each said junction, and to join each said associated pair after they have passed the junction. The resultant combined cell may be shortened to conform with the maximum number of vehicles which it may be required to accommodate.

Thus it will be seen that clear spaces may be generated between individual vehicles within the same cell, after either convergent or divergent junctions, and means may be provided, as hereinafter described, to close up such spaces so as to form a single contact train, and also to close up the united contact train to the front or rear of the cell.

Off-line stations may be used, with cells being duplicated at the divergent junctions leading thereto and consecutively paired cells formed for merging at the subsequent convergent junction, which convergent and divergent junctions are to operate as described above. The means for providing the cells, such as duplicated signal rails and associated on-board slipper members individually associated therewith (which may be necessary in any case in order to provide one each side at junctions) may be utilised to provide overlapping cells on one and the same section of track. One such cell may govern the vehicles awaiting passengers at a station (or waiting for a space at a platform) and the other may govern the departure of vehicles carrying passengers. According to this feature, each vehicle is provided with an automatically operated on-board change-over switch, whereby it may select to join with the cell appropriate to its condition. For example a signal rail may be provided on one side of the rail for a cell governing arrival of the vehicles, and a signal rail may be provided on the other side of the rail for a cell governing departure of the vehicles.

Each cell may comprise a vehicle position command, wherein individual pacemakers (as hereinafter defined)

are provided for each vehicle, said pacemakers being caused to move along the track at the same speed as the cell itself.

The term "pacemaker", where used in this specification in relation to vehicles, means an imaginary marker representing the commanded position of a specific datum point on the vehicle at any instant. Said pacemakers may be stationary or caused to move along the track, either continuously or in finite steps. It will be appreciated that said datum point of the vehicle will coincide with the pacemaker when the vehicle is in its correct commanded position. Similarly, an imaginary marker which represents the commanded position of the leading end of a cell will be referred to herein as the cell pacemaker.

Means may be provided to control said vehicle position commands in such manner as to effect relative movement between the pacemakers of vehicles within the cell to close up any clear spaces between said vehicles and thereby to form a contact train of the vehicles. Said means may comprise a length of track (hereinafter referred to as a datum block) having means for detecting the presence of spaces between adjacent vehicles on that length of track, and controlling operation of said vehicles in a manner to close up said spaces.

Each vehicle may be provided with three coordinated closed-loop on-board control subsystems, governing respectively speed, position and the distance between adjacent vehicles within the same cell.

In any of the above described arrangements, vehicle speed and/or position commands may be supplied by a pulse train, which is preferably externally generated and conveyed to the vehicle.

On-board means may be provided for comparing the vehicle speed or position command supplied by said pulse train with a signal indicative of the actual speed or position respectively of each vehicle, and for controlling the vehicle in a manner to reduce any detected error to zero. For example, the signal indicative of the actual position of the vehicle may be derived from stationary elements spaced apart along the length of the track.

In the case where spaces between adjacent vehicles are to be closed up, this may be effected by temporarily varying the pulse train or the signal derived from said stationary elements in a manner to induce vehicle position errors such that reduction of those errors to zero will effect closing up of the vehicles. For example, the signal derived from said stationary elements may be varied by rendering certain of said elements inoperative.

Each cell may comprise a wave, means being provided whereby said wave is flattened at positions occupied by vehicles within the cell. Thus, the commanded speed at the front of the cell may be substantially equal to that at which the cell is itself moving (being zero if the cell is stationary). The remainder of the cell may be divided into blocks of equal length, and equal to the vehicle length, and means may be provided whereby there is a positive increment in commanded speed for every vacant block, but no such increment for an occupied block. By this means, vehicles may be closed up to the front of the cell, or, by corresponding means, to the rear of the cell. This feature may be used as an additional safety provision.

Each vehicle may be provided with an on-board control subsystem incorporated in a micro-computer.

The term "track", as used in this specification, may include means for the support and guidance of the vehicles, power supply and signal rails running parallel to the direction of motion of vehicles, and stationary members for interaction with passing vehicles.

DETAILED DESCRIPTION OF THE PREFERRED EMBODIMENTS

Figure 1:
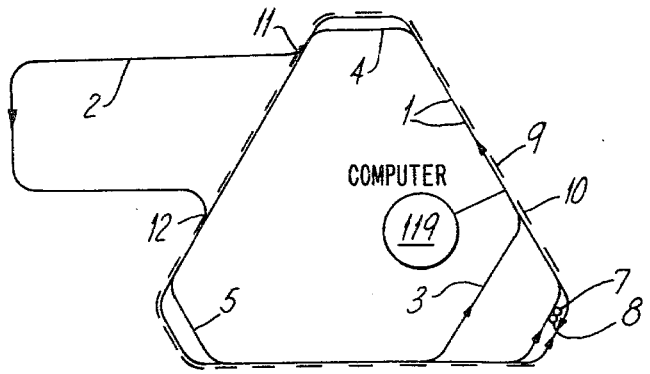
FIG. 1 is a simplified diagrammatic plan of a transportation system.

FIG. 1 is a schematic plan of a simple transportation installation comprising a closed circuit track 1, with off-line sidings 2 and 3 for a depot and for reserve vehicles respectively. The siding 2 is connected to the closed circuit track 1 by junctions 11 and 12, and further similar junctions may be provided to connect further portions of track to the main closed circuit. Off-line stations 4, 5 and 6 are shown, whereat vehicles such as 7 and 8 may stop clear of through traffic.

Cells, indicated diagrammatically at 9 and 10, are controlled by a permanently stationary computer 119, and circulate unidirectionally around the track, as indicated by arrows, at speeds which may change from place to place around the track. The boundaries of each cell are defined, at any instant, by the characteristics of vehicle command signals, and the nominal commanded speed for vehicles within each cell conforms to the speed of the cell itself, being identical at all locations along the length of the cell. Headway between cells may, for example, be approximately 30 seconds, with maximum cell length approximately equal to the separation distance between adjacent cells at full speed (provided that the minimum cell speed is sufficient to ensure safe separation).

Although FIG. 1 shows cells moving around the main track circuit only, the cells will also, of course, be movable through stations, sidings and other parts of the track.

Figure 2:
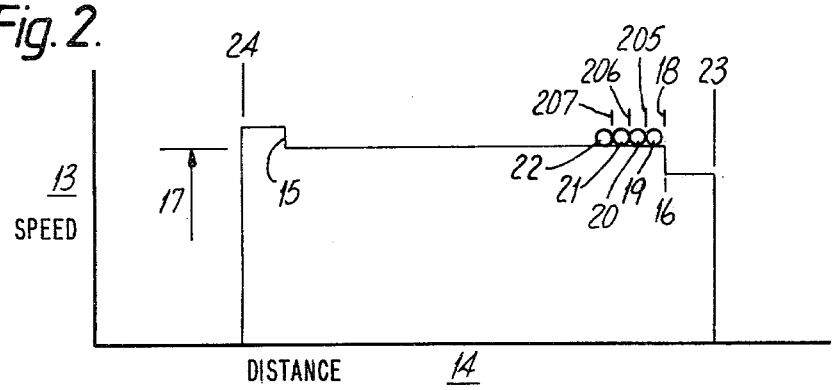
FIG. 2 is a graphical representation of a single deterministic cell.

FIG. 2 is a graph representing a single deterministic moving cell. As previously mentioned, a speed command is to be conveyed to each vehicle, at all times. In FIG. 2 this commanded speed 13 is plotted against distance along the track 14, and the moving cell therefore comprises substantially a length 15–16 of the track along which the commanded speed 17 is constant and is equal to the speed, or mean effective speed, at which the cell moves from left to right along the track. Speed commands may be conveyed to vehicles along distinct consecutive blocks of track so that the cell comprises several consecutive blocks of commands, and the leading and trailing ends thereof move forward in finite steps.

Referring again to FIG. 2, the leading vehicle's pacemaker (representing the commanded position of the vehicle, as previously explained) is indicated at 18 which, in this case, coincides with the cell pacemaker at 16. Vehicles 19 to 22 are in end-to-end contact, closed up at the front of the cell, their pacemakers being indicated at 205, 206 and 207 respectively.

The cell is preceded by a zone, 18 to 23, wherein the commanded speed is less than that at which the cell is itself moving. Under normal circumstances the control means provided will prevent vehicles from entering this zone, but is provides a safety measure to close up any vehicle whose speed control system is defective, and to restore it to the proper zone within the cell. Similarly, a zone 15 to 24 of higher commanded speed follows the cell, so as to speed up any vehicle tending to drop back due to a defective speed control. Such zones are to prevent vehicles leaving the cell, whereby they might enter a portion of track between consecutive cells, or in other ways impede traffic movements.

Figure 3:
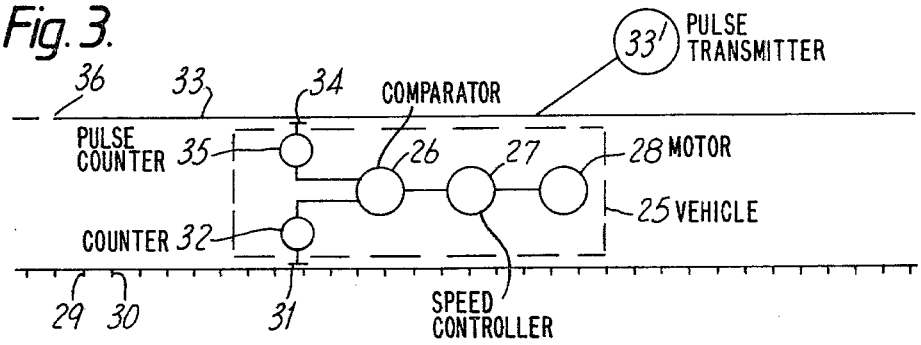
FIG. 3 shows diagrammatically a vehicle position control subsystem.

FIG. 3 is a diagram representing a position control subsystem by means of which the pacemaker of a vehicle 25 may be provided. The vehicle 25 moves from left to right and is provided with on-board switching together with means of buffering and automatic coupling (not shown). On-board control members are provided as follows. A comparator 26 governs a speed controller 27 which governs the speed of the vehicle traction motor 28. Equally spaced distance markers, such as 29 and 30, are provided along the track and a vehicle-mounted distance marker detector 31 communicates with a counter 32 with continuously communicates its count to the comparator 26. Simultaneously, clock pulses are provided to a conductor rail 33 (which, for control purposes, may be divided into discrete blocks, as at 36) from a clock pulse transmitter 33'. The clock pulses are picked up by an on-board slider 34 co-operating with the rail 33, whereby they are communicated to a clock pulse counter 35 and thence to the comparator 26. Means are provided automatically to re-set both counters simultaneously. Thus said clock pulse and distance markers provide a vehicle pacemaker or commanded position which is derived and held on-board the vehicle. Should any error develop in the vehicle's position, this will be detected by a discrepancy between the two counts, and the vehicle speed will be altered to reduce the error to zero and hence restore the vehicle to its correct position in relation to its pacemaker.

Although the on-board members of the subsystem are shown separately in order to illustrate their function, in practice the functions of the comparator 26 and the counters 32 and 35 may be carried out by a suitable programmed on-board micro-computer.

The distance markers, such as 29 and 30, may be provided by transmission means, such as light emitting diodes. Alternatively, they may comprise reflecting surfaces, such as brightly painted or reflecting bands, or a strip of corrugated material extending along the track. In appropriate cases, on-board lighting may be provided and on-board detectors may comprise light-sensitive or other means. It will be seen that such markers, in conjunction with the high frequency clock pulse or other pulse train, provide substantially continuous position command and position measurement for a passing vehicle.

Figure 4:
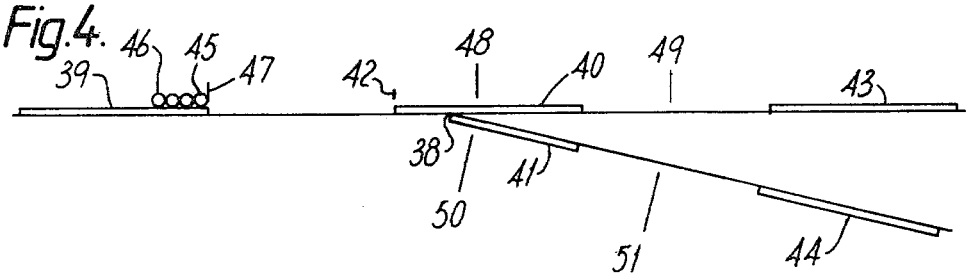
FIG. 4 shows diagrammatically the duplication of a cell passing a divergent junction.

FIG. 4 is a diagram showing the duplication of a cell as it passes a divergent junction. The cells may or may not contain vehicles and are represented as travelling from left to right past a divergent junction 38. A cell 39 is approaching the junction, with vehicles 45–46 closed up to the cell pacemaker 47. There is indicated at 40 a cell passing the junction, and becoming duplicated to form a cell 41 which has the same length as the cell 40. The portions of both cells 40 and 41 upstream of the junction 38 are one and the same and terminate at 42. Cell 43 has passed the junction, having been duplicated to form cell 44. Both cells 43 and 44 are of the same length and are the same distance from the junction. Vehicles, such as 45–46, are self-routing. Thus some vehicles are routed to each side of the junction, thereby causing clear spaces between vehicles in each cell which had previously formed parts of a coupled train, and also between the leading vehicle and the pacemaker in one of the two cells. Such spaces are to be closed up by the following means.

Datum blocks such as 48–49 and 50–51 are located after the junction, on each side respectively. Such datum blocks are substantially of the same length as the cells, which are also all of the same length. Thus each moving cell will momentarily coincide in position with a respective datum block on each side of the junction concerned.

Figure 5:
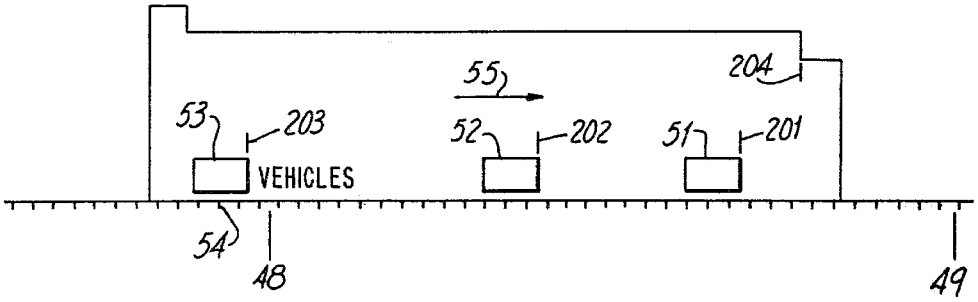
FIG. 5 shows diagrammatically a cell approaching a datum block in which vehicles are closed up.

FIG. 5 is a diagram representing one such datum block momentarily before a cell reaches the position to coincide therewith. The cell pacemaker is indicated at 204. Separated vehicles 51, 52 and 53 within the cell are counting close-pitched distance markers such as 54, whereby their pacemakers 201, 202 and 203 respectively are derived, using also the clock pulse sequence, as previously described. Also, a simple speed command is conveyed to them by the frequency of the clock pulse sequence. A graph corresponding to FIG. 2 is superimposed, representing the cell. The direction of motion is indicated by the arrow 55 and the limits of the datum block by 48 and 49.

Figure 6:
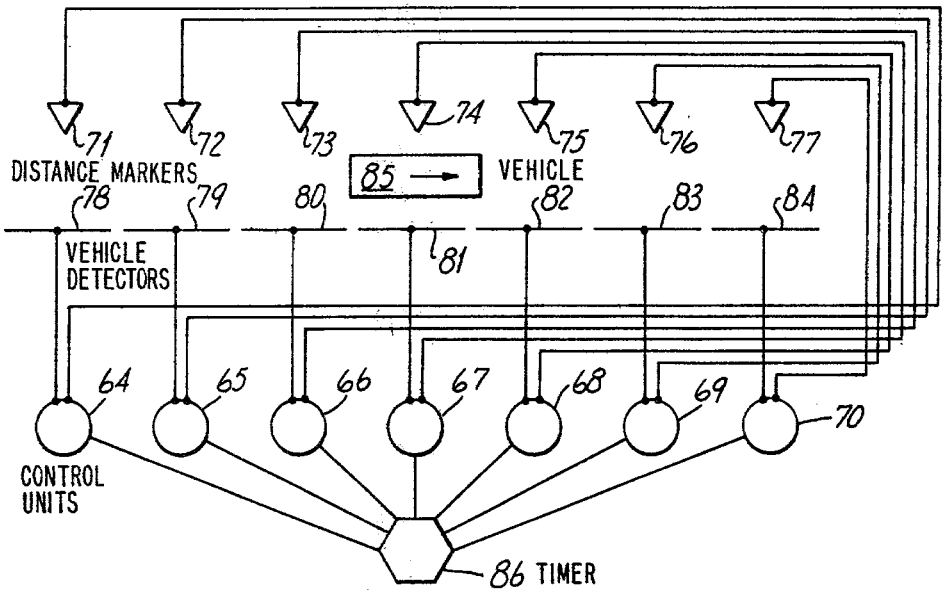
FIG. 6 shows part of the control system of a datum block.

FIG. 6 is a diagram showing special provision for such a datum block whereby at the instant when any such cell coincides therewith, the distance markers at positions unoccupied by vehicles are rendered inoperative and are caused to remain inoperative until the cell (and all or any vehicles therein) has passed beyond the datum block. Such distance markers are subsequently to be rendered operative again before the arrival of the next cell. Then the sequence is to be repeated, whether or not said next cell contains any vehicles or any clear spaces between vehicles.

Each distance marker, such as 71 to 77, is individually associated with a trackside control unit, such as 64 to 70, and each such controller is connected with a specific vehicle presence detector such as 78 to 84.

The vehicle presence detectors may each comprise a short block of control rail over which slides a vehicle-mounted member, or may comprise any other suitable means, such as optical or electromagnetic means. For example, two signal rails may run parallel with the direction of motion of vehicles, and suitable vehicle-mounted carbon slippers may complete an electrical circuit between them, which may be detected by a conveniently mounted stationary member.

Vehicle 85 moves from left to right. Each controller is connected to a timer 86, whereby it is caused to operate the distance marker associated with it, in the above-mentioned manner. Since cells are deterministic, their movements are governed by time, and it is only necessary to maintain synchronism between the timing devices controlling the movement of the cells and the operation of said control units, respectively, to ensure the above-mentioned synchronous operation.

Figure 7:
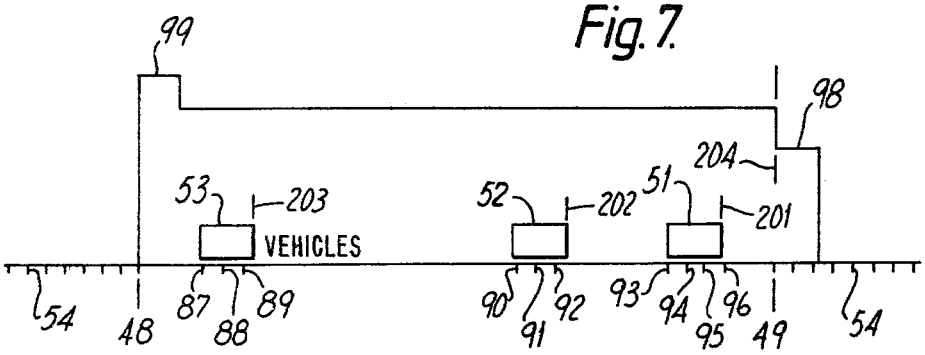
FIG. 7 is a further representation of a datum block at the moment when a cell coincides therewith.

FIG. 7 is a diagram corresponding to FIG. 5, but representing the moment when the cell coincides with the datum block 48–49. Controls such as those represented in FIG. 6 have operated, whereby distance markers in the spaces 48 to 87, 89 to 90, 92 to 93, and 96 to 49, which are not, at the datum time represented, occupied by vehicles, are rendered inoperative. Others, such as 87 to 89, 90 to 92, and 93 to 96, are to remain operative at least until the arrival of the next cell. Other distance markers, such as those indicated at 54, outside the datum block, are permanently to remain operative. The cell pacemaker is indicated at 204. This follows the reduced speed zone 98, and distance markers in the zone 98 are operative. Distance markers for the increased speed zone 99 which follows the cell are subject to the control arrangements represented in FIG. 6.

Figure 8:
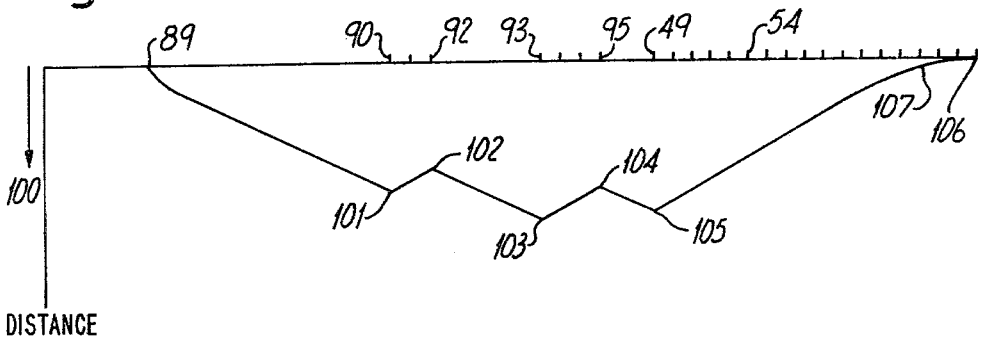
FIG. 8 is a graphical representation of the position control subsystem of a vehicle, FIG . 9 represents the vehicles of FIG. 7 shortly after they have left the datum block.

FIG. 8 is a graph representing the position control subsystem of a vehicle such as 53, for the period following the instant represented by FIG. 7. The horizontal axis represents the distance along the track and the track positions referred to in FIG. 7 are marked thereon. The vertical axis 100 represents (distance, measured along the track, between perceived position and commanded position). The sequence is as follows:

When the front of the vehicle passes the point indicated at 89, it ceases to count distance markers (since they have been rendered inoperative between 89 and 90) but continues to receive clock pulses. Thus its perceived position immediately begins to drop behind its commanded position, although the gradient of the line representing this, 89 to 101, is modified by the resultant increase in vehicle speed. The on-board speed control of the vehicle responds to increase the speed. Then, as distance markers 90 to 92 are counted, the perceived position tends to catch up on its commanded position, so that the line 101 to 102 has a positive gradient. The corresponding sequences are repeated for points 102 to 103, 103 to 104, 104 to 105, and 105 to 106. The curved portion 107 of the line 105 to 106 results from speed reduction as the vehicle approaches its commanded position or pacemaker. It is noteworthy that this graph is idealised to the extent that the movements of perceived and commanded positions really take place in finite steps.

Figure 9:
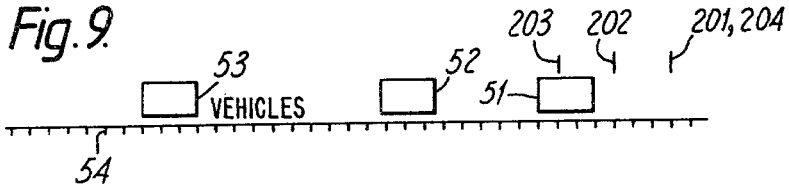

FIG. 9 shows the relative positions of vehicles and pacemakers, as for FIG. 7, shortly after leaving the datum block. The pacemaker 201 for the leading vehicle has been advanced to coincide with the cell pacemaker 204, and the pacemakers 202, 203 for following vehicles are closed up at vehicle-length separation behind.

Vehicles will then close up on their individual pacemakers. Thus the vehicle 51 will close up on the cell pacemaker 204 and vehicle 52 will establish end-to-end contact therewith, with automatic coupling. Vehicle 53 will establish contact with vehicle 52, in the region of 106, when automatic coupling may take place, after which the vehicles may proceed generally as represented in FIG. 2.

Provision is made to re-set automatically the pulse and distance marker counters, at suitable occasions, for all vehicles within the same cell, simultaneously. This may conveniently be done at datum blocks, at the instant represented in FIG. 7, for example by a track-to-vehicle command signal initiated by a synchronised timing device and communicated to vehicles through a conductor rail and slippers on each vehicle. Provision may also be made to correct for any isolated distance marker which may erroneously not be counted and/or for any isolated failure to count a clock pulse.

In any case of resetting a distance marker counter and clock pulse counter to zero, such resetting is to reset the vehicle's pacemaker to correspond to the actual positions of said vehicle at that time. Subsequently, each clock pulse (or other distance command increment) may correspond to a commanded advance in the pacemaker, as measured from its position when reset. Similarly, the speed command subsystem may be based upon a command which specifies a time interval, which time interval is inversely related to the commanded speed, during which variable time interval the vehicle is always commanded to travel a specific distance. The speed measurement may comprise a fixed and unchanging time interval which is conveniently short, during which interval means are provided to measure the actual distance travelled, and hence the average speed which substantially represents the momentary speed at the conclusion of said time interval.

Figure 10:
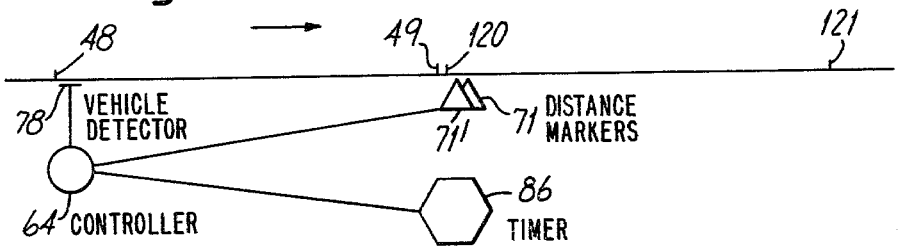
FIG. 10 shows diagrammatically an alternative arrangement whereby vehicles may be closed up.

FIG. 10 represents an alternative arrangement whereby vehicles may be closed up to a cell pacemaker at the rear of the cell. Datum block 48–49 contains similarly spaced vehicle presence detectors, such as 78, each of which is connected to a controller, such as 64, but the controller in this case operates a distance marker such as 71'. A closing up block 120–121 is provided following the datum block 48–49, and is of the same length as the datum block. Throughout the closing up block, distance markers are provided at half the normal pitch, and permanently operative distance markers, such as 71, alternate with controllable ones, such as 71'. The controllable distance markers 71 are operated generally as before described in FIG. 6, but in this case they are controlled by vehicle presence detectors in the upstream datum block. Thus, distance markers such as 71' are to be rendered inoperative by the detection of a vehicle at each associated vehicle presence detector. It will be seen that, by this means, spaces between vehicles in the datum block count as double distance in the closing up block, whereby vehicles' pacemakers are closed up to the rear of the cell.

In a further alternative arrangement, instead of the vehicle presence detectors rendering distance markers inoperative, they cause additional clock pulses to be transmitted to all vehicles within the same datum block, but downstream of each said vehicle presence detector. It will be appreciated that this will also have the effect of closing up the vehicle pacemakers.

Alternatively, to close up vehicles to a following pacemaker, the vehicle presence detectors may be provided with means whereby one or more clock pulses are prevented from reaching those vehicles, within the same cell, which have already passed the vehicle presence detector concerned with a clear space is passing it. By this means, pacemaker for the leading vehicles are closed up rearwardly.

Figure 11:
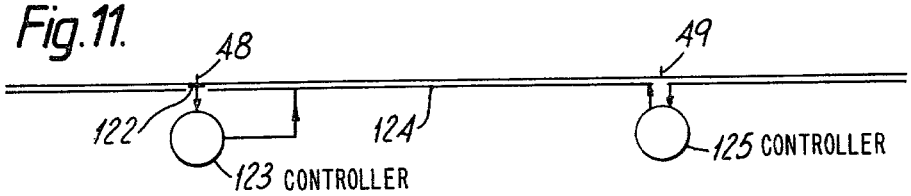
FIGS. 11 to 18 show diagrammatically further alternative arrangements whereby vehicles may be closed up.

FIG. 11 shows a variant whereby vehicles may be closed up to a following cell pacemaker. At the entry position to the datum block 48–49, a vehicle presence detector 122 is provided. In order to increase precision, relatively high frequency clock pulses are preferable and the active length of the vehicle presence detector is to be correspondingly reduced. The detector 122 communicates with a control member 123, whereby clock pulses are provided to a signal rail 124, and thus to all vehicles communicating therewith (i.e. which have entered the datum block) only when a vehicle is present at 122. A further control member 125 is provided with means to restore normal frequency clock pulses to the signal rail 124 when the leading portion of the cell passes the downstream end of the datum block, at 49.

As a variant to the arrangement shown in FIG. 11, instead of causing clock pulses to cease, the control member 123 may be caused temporarily to activate additional distance markers between those which are normally pitched and permanently operative.

Figure 12:
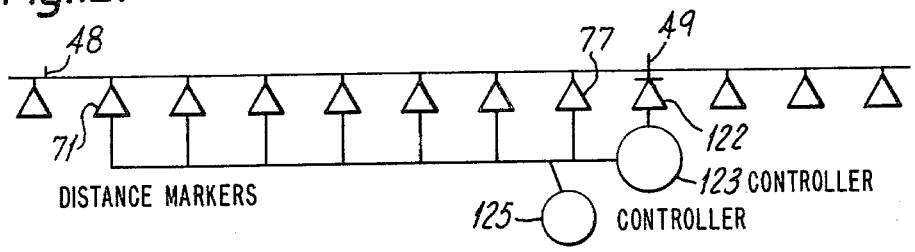

FIG. 12 is a diagrammatic representation of a variant by means of which vehicles may be closed up to a leading cell pacemaker. The datum block is indicated at 48–49 and distance markers outside the datum block are permanently operative. Those within the datum block, such as 71 to 77, have dual controls, as follows.

While a cell is moving into the datum block, the distance markers 71 to 77 in the datum block remain continuously operative, under the control of unit 125. At the datum time, their control is transferred to the vehicle presence detector 122 and controller 123, whereby they are all collectively rendered operative whenever a vehicle is detected at 122, but inoperative while no vehicle is so detected. By this means, distance markers not counted by the vehicles correspond to total clear spaces between said vehicles and the leading cell pacemaker, whereby they are closed up in contact with each other, and to the cell pacemaker.

Figure 13:
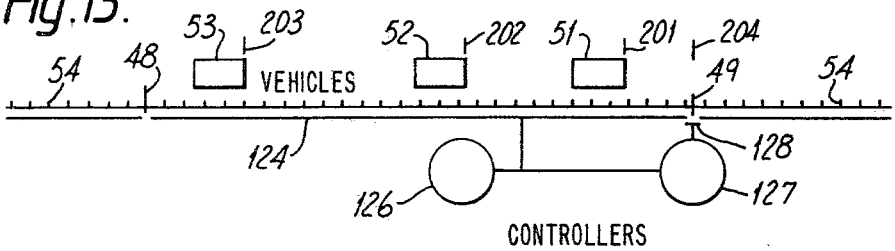

FIG. 13 is a diagrammatic representation of a variant of the arrangements of FIGS. 11 and 12, whereby vehicles may be closed up to a leading cell pacemaker. Permanently operative distance markers 54 are provided throughout the datum block 48–49 and adjacent sections of track. Clock pulses are provided to a signal rail, including signal rail block 124 for the datum block. Prior to the datum time, clock pulses are conducted to the signal rail 124 by a controller 126, at normal frequency corresponding to the speed of the cell. Thereafter they are provided by a controller 127, at frequencies depending upon the vehicle presence detector 128. The vehicle presence detector may effectively relate to a short distance, covering the downstream end of the datum block. If a vehicle is detected, clock pulses are provided to the rail 124, and hence to vehicles within the datum block, at normal frequency. If no vehicle is detected at 128, double frequency clock pulses are transmitted to the rail 124. By this means, individual vehicle pacemakers 201, 202 and 203 will be closed up to the leading cell pacemaker 204, in similar manner to that shown in FIG. 8. Simultaneously, in cases where the clock pulse also governs the commanded speed, such vehicles' commanded speeds are correspondingly increased. The resultant speed increases will be consistent with the associated advance in each vehicle's pacemaker, and will be smoothed to avoid any suddenness by an on-board member, which may be the microprocessor coordinator as hereinafter mentioned.

Figure 14:
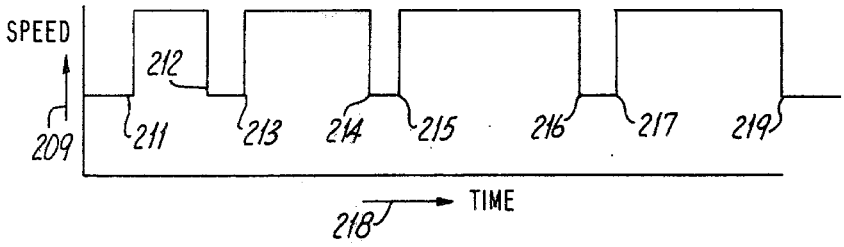

FIG. 14 shows a graph of commanded speed, in this case clock pulse frequency 209 at the datum block plotted against time, 218, for the interval following datum time 211 for the variant shown in FIG. 13. It will be noted that the clock pulse frequency is immediately doubled, due to the absence of a vehicle at detector 128, (see FIG. 13). It falls to normal frequency at positions 212–213, 214–215 and 216–217 corresponding to the passage of vehicles 51, 52 and 53 over detector 128, and may be re-set to normal frequency at 219 after the cell has passed. By this means the pacemakers 201, 202 and 203 are closed up, as for FIG. 8, and followed by the vehicles.

Figure 15:
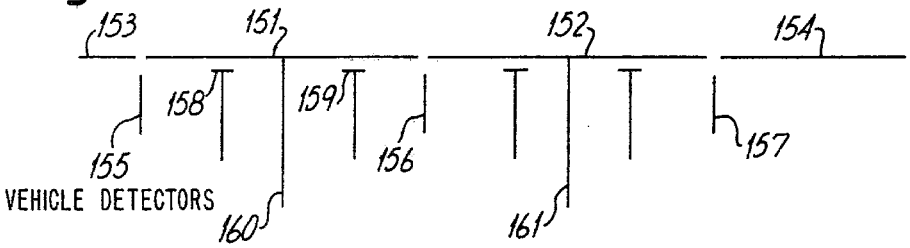

FIGS. 15 to 18 represent alternative and/or back-up means of closing up vehicles. FIG. 15 shows a part of a section of track, which in this instance may be divided into blocks, such as 151 to 154. Each said block is provided with means of communicating speed commands to vehicles thereon, such as a trackside signal rail, divided into blocks, each of which blocks is provided with a connection such as 160 and 161, whereby the speed command signal is conveyed from a controller. Each said block is also provided with at least one vehicle presence detector, such as 158 and 159.

Figure 16:
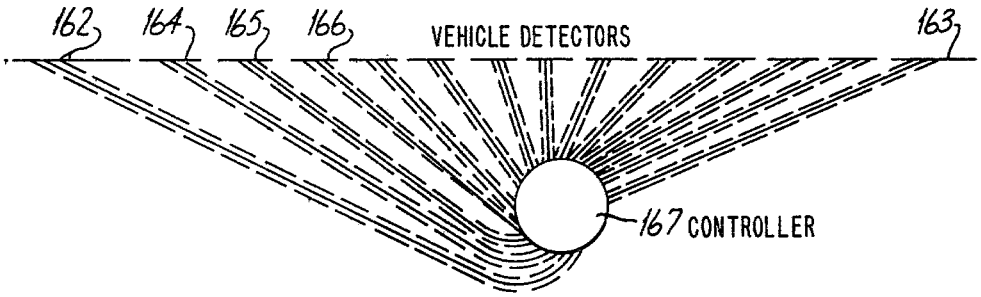
Figure 17:
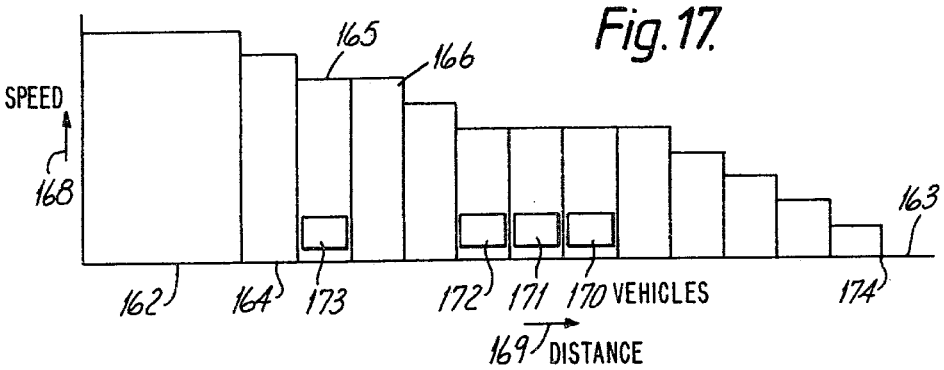
Figure 18:
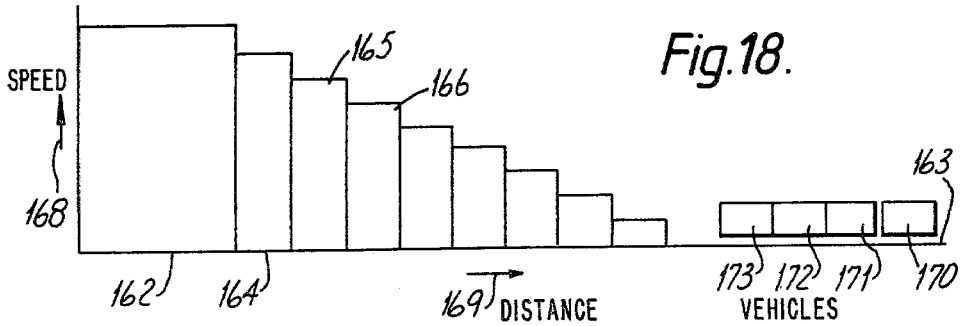

FIG. 16 is a block diagram showing a section of track in accordance with this feature. Individual blocks, such as 162 to 166, each comprise at least one vehicle presence detector, and speed command means, as shown in FIG. 15. The vehicle presence detectors and speed command means are each individually connected to the controller 167. FIGS. 17 and 18 are graphs showing commanded speed 168 plotted against distance along the track 169. The horizontal axes of the graphs represent blocks corresponding to those shown in FIG. 16.

A group of vehicles such as 170 to 173 are represented as moving from left to right and for convenience have been drawn in immediately above the horizontal axis. The controller 167 is provided with means whereby a ramped speed command is provided to consecutive blocks, as shown in FIGS. 17 and 18. This ramped speed command comprises a wave made up of incremental steps in an upstream direction. It may commence with a zero speed command, as shown, or it may merely commence at some pre-set speed other than zero. In the case shown, the first step (i.e. the right hand one, at 174) is stationary before the arrival of a vehicle. However, means are provided whereby, if a block is occupied by a vehicle, there is no increase in commanded speed for that block. Individual blocks are preferably to have the same length as individual vehicles, or there may be a simple whole number of blocks per vehicle length. Thus for example, FIG. 17 shows a group of vehicles, 170 to 173, moving from left to right and programmed to be brought to rest as shown in FIG. 18. It will be noted that as the group of vehicles moves from left to right, those in end-to-end contact always receive the same commanded speed, and that as any vehicle enters an unoccupied block its speed is commanded to fall to a pre-set and incrementally lower level.

It is noteworthy that this system is especially suited for bringing vehicles to rest, for example at a station, or in the case where specific operating authorities prefer them to be brought to rest when they are brought into end-to-end contact.

Figure 19:
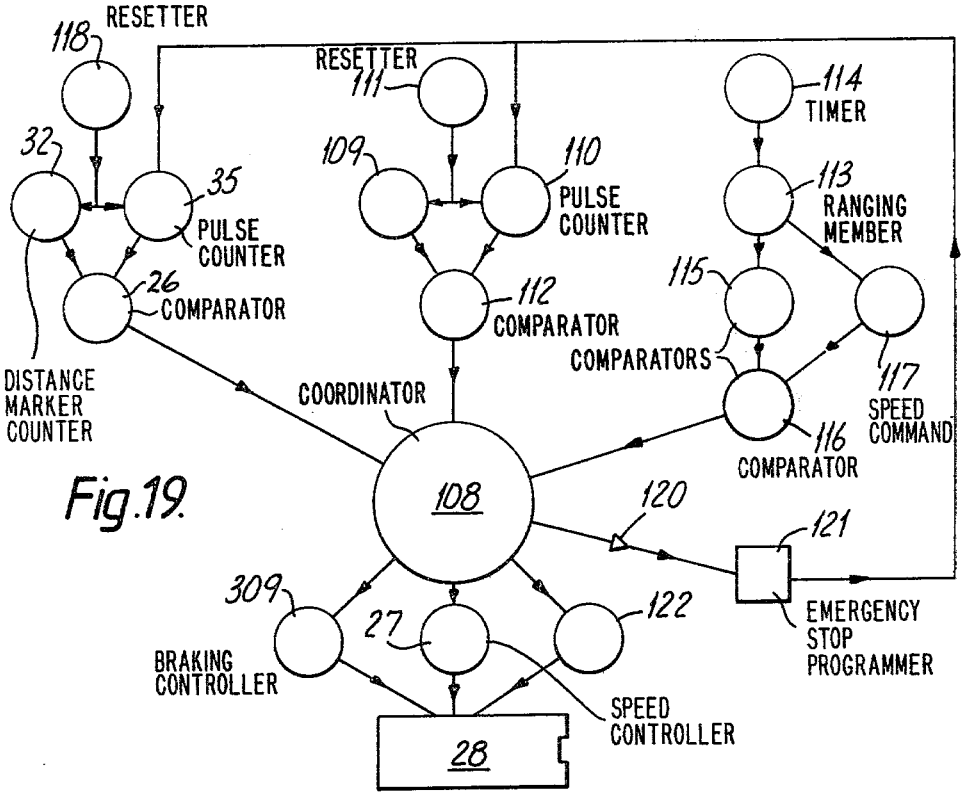
FIG. 19 shows diagrammatically a still further arrangement for closing up vehicles, comprising three closed-loop control subsystems.

FIG. 19 is a block diagram showing features of another arrangement in accordance with the invention, whereby the means of closing up vehicles comprises three closed-loop control subsystems, relating to position, speed, and relative closing speed (ranging) respectively, and whereby signals from all three closed-loop subsystems are communicated to a single co-ordinator (which may be a micro-processor or micro-computer) whereby compromise commands are issued to the traction motor speed controller and braking controller, and whereby any descrepancy which may indicate a defect is detected and the vehicle is automatically withdrawn from service, but whereby any vehicle containing such a defect is normally to be enabled to complete its journey in safety, before being withdrawn from service for repair. Redundancy may be used for individual units, but parity checks between triplicated units will not usually be necessary. In addition, the co-ordinator is provided with means to detect any immediately dangerous conditions and to initiate a safe emergency stop procedure for all vehicles concerned. Said procedure embraces the situation resulting from a total electrical failure in any one vehicle, even at the most critical stage of closing up.

Referring to FIG. 19, the position control subsystem comprises a distance marker counter 32 and a clock pulse counter 35. These communicate respectively the actual position (from the count of distance markers) and the commanded position (from the count of clock pulses) to the comparator 26, whereby a position error signal is communicated to the co-ordinator 108. Taking into account signals received from the other two closed-loop subsystems, the co-ordinator commands the speed controller 27 of the traction motor.

Member 118 is provided with means simultaneously to re-set counters 32 and 35, when commanded to do so by a track-to-vehicle signal, e.g. one received at the datum time corresponding to FIG. 7.

It has been mentioned that speed measurement may be based on a simple count of operative distance markers. However, this is slow to indicate any error in speed, and cannot operate while passing places where the distance markers are inoperative. In an alternative embodiment an improved closed-loop speed control subsystem is provided as follows.

A continuous and close-pitched means of measuring distance is provided, such as a toothed wheel counter. This counts teeth on a wheel as they pass a detector, the toothed wheel being directly connected with a vehicle support wheel. Any equivalent means may be provided instead. Meanwhile, a short-term clock pulse counter 110 may use the same clock pulse sequence as that in the position control subsystem. Resetting means 111 is provided whereby both counters are frequently and simultaneously reset, whereby substantially instantaneous readings of commanded speed and measured speed are provided. Both the toothed wheel counter and the short-term clock pulse counter are connected to the comparator 112, whereby a speed error reading is communicated to the co-ordinator 108.

It has been noted that the position control sub-system closes up vehicles, according to finite steps. For this and other reasons, it is insufficiently precise to ensure that vehicles are brought into end-to-end contact without shock. There may therefore be provided a relative closing speed control subsystem which controls the speed of any following vehicle when it approaches the vehicle in front of it sufficiently closely to require substantially continuous control relating to their continuously varying separation distance. It is to be programmed to close the vehicles up and establish end-to-end contact without shock, with buffering and optionally automatic coupling.

To provide this feature there may be provided a ranging member 113 which is mounted on board the following vehicle and comprises means to measure the distance separating it from the leading vehicle. It may become operative only when the two vehicles are relatively close together, for example within three meters of one another. It may comprise radar, secondary radar based upon a timed transmission from the rear of the leading vehicle, ultrasonic ranging, means based on measuring the intensity of a standard electromagnetic transmission (e.g. infrared) from the rear of the leading vehicle, or any other suitable means.

The ranging member is controlled by a timer 114, to provide a series of frequently repeated ranging measurements which are communicated to a primary comparator 115, whereby the actual closing speed (derived from consecutive measurements) is communicated to one side of a secondary comparator 116. Meanwhile, the actual separation distance is communicated to the member 117, which is programmed to provide a closing speed command which is related, in a predetermined manner, to the separation distance, and which thus communicates to the secondary comparator 116 a commanded closing speed appropriate to the particular separation distance. The comparator 116 compares this commanded closing speed with the actual closing speed, and communicates any error in closing speed to the co-ordinator 108 where it is given appropriate priority (for example, especially at close separation distances).

It will be seen that FIG. 19 represents three closed-loop subsystems, relating to position (items 118, 32, 35 and 26), speed (items 109 to 112) and relative closing speed, or ranging, (items 113 to 117). Each of said closed-loop subsystems comprises means whereby it obeys a specific command and subsequently detects the error (if any) in its own response to that command, and initiates appropriate corrective action. The specific command may be received from a source outside the vehicle, as previously described in relation to the speed and position commands, or may be derived from a preset programme, as is the case with the ranging subsystem described above, where the commanded speed of approach is related to the separation distance in a manner predetermined by the programmed member 117. Moreover, this feature provides for the three closed-loop subsystems all to become effective through their influence upon one and the same traction motor, and to be co-ordinated in a manner to avoid hunting, and whereby all three are brought into play to provide safety together with reliability through an element of redundancy during the critical closing up operation.

The functions of the individual components, such as counters 32 and 35, and comparator 26 (in the position control subsystem), counters 109 and 110 and comparator 112 (in the speed control subsystem), and comparators 115 and 116 and programmed member 117 (in the ranging control subsystem), may be carried out by a suitably programmed on-board computer which, for example, may constitute the co-ordinator 108. The co-ordinator is also provided with means of communication to an on-board electrical braking controller 309, whereby regenerative braking is automatically supplemented as necessary by d.c. injection and/or reverse plug braking, or other such means.

Experience at Morgantown has shown that the majority of breakdowns are caused by fail-safe systems: failures in such systems are necessarily followed by an interrogation sequence of the vehicle concerned, at long distance from the manned control position, and subsequently it is usually found that it is safe for the vehicle to proceed. In the embodiment according to the invention, the co-ordinator 108 may comprise a micro-processor or computer, whereby said interrogation sequence may be carried out almost instantaneously, on-board the defective vehicle, by said micro-processor or computer, and, in most instances, stoppage may be avoided and the vehicle automatically withdrawn from service and routed to the maintenance depot for repair, on the completion of the passenger-carrying journey, and without dislocating other traffic. In this connection, it is note-worthy that it is now a much more attractive proposition to provide a micro-computer on-board every vehicle than it was ten years ago, when the Morgantown system was designed.

In order that this control system may be more fully understood, examples follow, to illustrate its responses to various circumstances met in practice.

Consider closing up, as initiated at the datum time represented by FIG. 7. At that instant, the cell containing separated uncoupled vehicles 51 to 53 coincides with the datum block 48–49, and the controller 86 (FIG. 6) is caused to render all distance markers within the datum block, and corresponding to positions not at that time occupied by vehicles, to be rendered inoperative. At the same instant the member 118 re-sets the pulse counter 35 and distance marker counter 32 to zero simultaneously, thereby eliminating any errors which might previously have been introduced by miscounts, and also any previously recorded error in position. A vehicle such as 53 continues to receive clock pulse counts and a series of counts from close-pitched counter 109. Thus it remains under the command of the speed control subsystem, whereby constant speed may be maintained, or appropriate speed changes executed as required.

However, the vehicle 53 passes beyond the distance marker 89 and its position control subsystem continues to count clock pulses, without passing nor counting any operative distance markers. Thus it builds an error in its perceived position, which error commences to grow, and subsequently follows the graph of FIG. 8. This perceived error is communicated to the co-ordinator 108, which will take into account the fact that there is no apparent error in speed and also that there is no vehicle closely leading vehicle 53. Thus the coordinator will recognise conditions for closing up and will allow appropriate increase in speed to be initiated by the position control subsystem. Should any change in the commanded speed take place while the vehicle is still closing up, then the output command from the coordinator will be based on the command speed at any moment, with an addition appropriate to closing up. By this means, the following vehicle 53 will be brought close to the leading vehicle 52, while simultaneously the leading vehicle 52 will have been brought close to, and perhaps into contact with, the vehicle 51 leading it. When the vehicle 53 is close to the vehicle 52, the relative position control sybsystem in the following vehicle will take priority in effecting end-to-end contact between them, optionally with automatic coupling, and without stock. In general, this final closing up will be fully compatible with the output signals from the position command subsystem, but it would be more sensitive, and respond more quickly to any change in the speed of the leading vehicle.

To refer back to FIG. 8, the vehicle 53 accumulates an increasing perceived error (i.e. the vertical axis in FIG. 8) until it reaches distance markers 90 to 92. These will have remained operative because they correspond to the position occupied by the vehicle 52 at the moment when closing up was initiated. Thus the perceived error in position of the vehicle 53 will fall as it passes distance markers 90 to 92, because its speed will already have increased somewhat above the commanded speed. Subsequently, it will traverse the length of the track from 92 to 93 (which previously corresponded to a clear space between vehicles) and accumulate a further perceived error in position, as shown in FIG. 8. On passing 97, the end of the closing up length, normal and continuously operative distance markers are encountered and counted. Thus, at this point, the graph in FIG. 8, previously showing a negative value because the perceived position was behind the commanded position, will grow algebraically less (i.e. rise towards zero) since the vehicle's speed will be higher than that corresponding to the commanded speed, as implemented by the clock pulses. However, as it approaches zero, the position command subsystem will communicate to the co-ordinator a smaller perceived error in position, and the co-ordinator will reduce speed, generally in a manner to bring the vehicle 53 into contact with the vehicle 52, but without shock. At this stage, however, the ranging member 113 picks up the rear of the vehicle 52, and adjusts the speed of vehicle 53 to conform thereto, while closing upon it generally in accordance with the pre-set programme in member 117. Said closing programme imposes brisk positive closing up of the rear vehicle to the leading vehicle, regardless of changes in speed of the leading vehicle meanwhile, and concluded by contact between them substantially without shock.

It is a feature of this embodiment of the invention that said vehicle carries on-board means to compare its perceived position with its commanded position, and that means are provided whereby its perceived position is caused to fall behind the position corresponding to the distance travelled, by an amount substantially equal to all or any clear spaces between the vehicles which were within the same cell at the instant when said cell coincided with said specially equipped closing up length, or datum block.

During the closing up operation, various errors could be detected, whereby to ensure safety and allow the current journey to be completed before withdrawing the vehicle from service. For example, the relative position control subsystem might indicate that a vehicle was closely following another, while its position control indicated that it was still behind station. This might be caused either by an error in the position of the leading vehicle, or by an error in either the position control or the relative position control of the following vehicle. For these circumstances, the co-ordinator in the following vehicle might be programmed to test it's own vehicle's ranging control by a small closing speed. Said closing speed would risk slight shock, such as would cause slight discomfort to passengers, but without danger of injury. Then if contact was established, this might be accommpanied by automatic coupling, which would cause the vehicles to remain together until the next datum block, when their position control subsystems would be re-set, and thus, for the moment at least, would be fully compatible. If, on the other hand, the ranging control was defective, it would be probable that no such contact would then result, and said vehicle would reach its commanded position, although more slowly than usual. It is noteworthy that there would, in general, be no immediate danger should vehicles remain separated for the remainder of any one journey.

As a further example, the speed control subsystem might indicate that a vehicle was below its commanded speed, while its position control indicated that it was ahead of its station, and its relative position control subsystem indicated that it was closely following another vehicle. This might be caused, for example, by an error in its position control subsystem, or in its speed control subsystem. Its co-ordinator could be programmed, under these circumstances, to bring the following vehicle safely (but not necessarily without any shock) into contact with the vehicle in front of it.

Nevertheless, there are some circumstances which could become immediately dangerous and the control system then provides duplicated or triplicated danger signals to the co-ordinator, as the following example shows.

Should a vehicle's speed control subsystem indicate a progressive fall in speed below the commanded speed, while its position control subsystem indicated that it was falling behind station, while its ranging subsysetem indicated that it was falling further behind the vehicle in front of it, then each of these signals would indicate a traction breakdown and initiate an emergency stop procedure. In fact, any one of these signals alone may be caused to initiate such emergency stop procedure.

Referring to FIG. 19, the co-ordinator 108 is provided with means to detect a potentially dangerous situation requiring a emergency stop. Through vehicle-to-track commuicator 120, it is arranged to activate trackside emergency stop programmer 121, whereby clock pulse frequency to all vehicles on the section of the track concerned is ramped down, bringing the traffic to rest, through counters 35 and 110.

Simultaneously, co-ordinator 108 causes a power hold-off mechanical brake in the defective vehicle (and optionally in others) to be short-circuited, whereby said brake is applied. Since the retardation from mechanical brakes is approximate, they are preferably adjusted to produce a slightly higher rate of retardation than the ramped decline in clock pulse frequency. Thus, if there is a total electrical failure in the defective vehicle, it will tend to close on that which is following it, which will automatically take appropriate action through its relative position control, rather than close on the vehicle in front of it, which would not have appropriate automatic controls to avoid shock.

Although the above-described control arrangements are particularly applicable to transportation systems specificaly designed for their use, it will be appreciated that features of the described control arrangements may equally be applied to the control of existing transportation systems originally designed for manual control, suitable modifications being made as necessary.

I claim:

1. A transportation system comprising a track, driven vehicles movable along the track, and control means for generating control signals effectively defining a series of spaced control areas movable along the track, each control area being of such length as to be capable of accommodating a plurality of vehicles simultaneously, wherein each vehicle is provided with on-board detection means responsive to the control signals for maintaining the vehicle within the confines of a control area, and the control means includes vehicle closing means for sensing the presence of gaps between a plurality of vehicles confined within a single control area and for causing relative movement of said vehicle with respect to one another to close up the gaps.

2. A transportation system according to claim 1, wherein the control means incorporates clock means for controlling the space-time relationship of the control areas such that the time taken for the control areas to travel between any two fixed points on the track is predetermined.

3. A transportation system according to claim 1, wherein a series of distance markers are spaced along the track, and the on-board detection means includes means for sensing the distance markers and means for determining the speed at which the vehicle is to be driven in dependence on the control signals and the spacing between the distance markers, the vehicle closing means being operative to modify the spacing of the distance markers to be sensed by the sensing means along a region of track in order to cause the vehicles to be driven at speeds to close the gaps between vehicles.

4. A transportation system according to claim 3, wherein the vehicle closing means is operative to render certain of the distance markers provided along said region of track incapable of being sensed by the sensing means, in response to detection of a control area within which a plurality of vehicles separated by gaps are confined.

5. A transportation system according to claim 3, wherein the vehicle closing means is operative to render additional distance markers provided along said region of track incapable of being sensed by the sensing means, in response to detection of a control area within which a plurality of vehicles separated by gaps are confined.

6. A transportation system according to claim 1, wherein the control signals generated by the control means are sequences of clock pulses whose frequencies are proportional to the command speeds of the vehicles, and the on-board detection means includes means for sensing the clock pulses and for determining the speed at which the vehicle is to be driven in dependence on the clock pulses, the vehicle closing means being operative to modify the frequency of the clock pulses to be sensed by the sensing means along a region of track in order to cause the vehicles to be driven at speeds to close up the gaps between vehicles.

7. A transportation system according to claim 6, wherein the vehicle closing means is operative to increase the frequency of the clock pulses sensed by the sensing means along said region of track, in response to detection of a control area within which a plurality of vehicles separated by gaps are confined.

8. A transportation system according to claim 6, wherein the vehicle closing means is operative to decrease the frequency of the clock pulses sensed by the sensing means along said region of track, in response to detection of a control area within which a plurality of vehicles separated by gaps are confined.

9. A transportation system according to claim 1, wherein a series of distance markers are spaced along the track, and the control signals generated by the control means are sequences of clock pulses whose frequencies are proportional to the commanded speeds of the vehicles, the on-board detection means incorporating means for counting the clock pulses, means for counting the distance markers, and means for comparing the counts of the counting means and controlling the speed of the vehicle in a manner to reduce any detected error to zero.

10. A transportation system according to claim 1, wherein the track includes at least one divergent junction, and the control means is operative to duplicate each control area on each of the two lengths of track diverging from the or each divergent junction, the on-board control means being operative to route each vehicle to one or other of said diverging lengths of track.

11. A transportation system according to claim 1, wherein the track includes at least one convergent junction, and the control means is operative to cause the control areas to move towards the or each convergent junction in consecutive pairs, each comprising a control area from each of the two lengths of track converging towards the convergent junction, and to merge together the control areas of each pair as it passes the convergent junction.

12. A transportation system comprising a track, a series of distance markers spaced along the track, driven vehicles movable along the track, and control means for generating control signals effectively defining a series of spaced control areas movable along the track, each control area being of such a length as to be capable of accommodating a plurality of vehicles simultaneously, wherein each vehicle is provided with on-board detection means incorporating means for sensing the control signals, means for sensing the distance markers, and means for determining the speed at which the vehicle is driven in dependence on the outputs of the sensing means, and the control means includes vehicle closing means for sensing the presence of gaps between a plurality of vehicles confined within a single control area and for providing modified control sensed by the detection means to cause relative movement of said vehicles with respect to one another to close up the gaps.

* * * * *